US009674936B2

(12) United States Patent
Hara

(10) Patent No.: US 9,674,936 B2
(45) Date of Patent: Jun. 6, 2017

(54) SUPERCONDUCTING ACCELERATING CAVITY AND ELECTROPOLISHING METHOD FOR SUPERCONDUCTING ACCELERATING CAVITY

(71) Applicant: MITSUBISHI HEAVY INDUSTRIES, LTD., Tokyo (JP)

(72) Inventor: Hiroshi Hara, Tokyo (JP)

(73) Assignee: MITSUBISHI HEAVY INDUSTRIES MECHATRONICS SYSTEMS, LTD, Hyogo (JP)

( * ) Notice: Subject to any disclaimer, the term of this patent is extended or adjusted under 35 U.S.C. 154(b) by 315 days.

(21) Appl. No.: 14/494,867

(22) Filed: Sep. 24, 2014

(65) Prior Publication Data

US 2015/0163894 A1 Jun. 11, 2015

(30) Foreign Application Priority Data

Dec. 5, 2013 (JP) ..... 2013-252262

(51) Int. Cl.
*H05H 7/20* (2006.01)
*C25F 3/26* (2006.01)

(52) U.S. Cl.
CPC ..... *H05H 7/20* (2013.01); *C25F 3/26* (2013.01)

(58) Field of Classification Search
CPC ..... H05H 15/00; H05H 7/20
See application file for complete search history.

(56) References Cited

U.S. PATENT DOCUMENTS

| | | | | |
|---|---|---|---|---|
| 6,348,757 | B1 | 2/2002 | Marini | |
| 9,006,147 | B2 * | 4/2015 | Taylor | C25F 3/26 505/300 |
| 2010/0116651 | A1 | 5/2010 | Mizuno | |

FOREIGN PATENT DOCUMENTS

| | | |
|---|---|---|
| CN | 101636528 | 1/2010 |
| JP | 2-220400 | 9/1990 |
| JP | 7-245199 | 9/1995 |
| JP | 2000-123998 | 4/2000 |
| JP | 2000-150198 | 5/2000 |
| JP | 3416249 | 6/2003 |

OTHER PUBLICATIONS

Extended European Search Report issued Jan. 29, 2015 in corresponding European patent application No. 14185683.1.

(Continued)

*Primary Examiner* — Nicholas A Smith
(74) *Attorney, Agent, or Firm* — Wenderoth, Lind & Ponack, L.L.P.

(57) ABSTRACT

Provided is a superconducting accelerating cavity 30 including: a cavity main body 10 formed of a superconducting material into a cylindrical shape; and a refrigerant tank 20 installed around the cavity main body 10 and storing a refrigerant which is supplied from the outside through a supply port 20*a* into a space formed between the refrigerant tank and the outer circumferential surface of the cavity main body 10, wherein the outer circumferential surface of the cavity main body 10 is coated with a metal coating layer 10*a* having a higher conductivity than the superconducting material.

7 Claims, 7 Drawing Sheets

(56) References Cited

OTHER PUBLICATIONS

L. Lilje et al., "Achievement of 35MV/m in the superconducting nine-cell cavities for Tesla", Nuclear Instruments & Methods in Physics Research. Section A: Accelerators, Spectrometers, Detectors, and Associated Equipment, Elsevier BV * North-Holland, NL, vol. 524, Nos. 1-3, May 21, 2004, pp. 1-12.
S. Mitsunobu et al., "Cryostat for TRISTAN Superconducting Cavity", Proceedings of the Fourth Workshop on RF Superconductivity, vol. 819, Oct. 1, 2010, pp. 805-819.
Office Action issued Feb. 16, 2016 in Japanese patent application No. 2013-252262 (with English translation).
Office Action issued Aug. 29, 2016 in corresponding Chinese patent application No. 201410497415.4 (with English translation).
Decision to Grant a Patent issued Oct. 25, 2016 in Japanese patent application No. 2013-252262.

* cited by examiner

SUPERCONDUCTING ACCELERATING CAVITY AND ELECTROPOLISHING METHOD FOR SUPERCONDUCTING ACCELERATING CAVITY

TECHNICAL FIELD

The present invention relates to a superconducting accelerating cavity and an electropolishing method for a superconducting accelerating cavity.

BACKGROUND ART

A superconducting accelerating cavity is a device for accelerating charged particles such as electrons, positrons, and protons by means of an accelerating electric field generated inside the cavity by an input of high-frequency power. When the inner surface of the main body of the superconducting accelerating cavity is not smooth, or when impurities are present on the inner surface of the main body, heat generation or electrical discharge is induced, which degrades the performance of accelerating the charged particles.

It is a known practice to perform electropolishing in order to smooth the inner surface of the main body of the superconducting accelerating cavity and remove impurities from the inner surface (e.g., see PTL 1). Eiectropolishing of the superconducting accelerating cavity is performed with an electrode installed on each of the inside of the cavity main body and the outer surface of the cavity main body, while the cavity main body is filled with an electrolyte.

CITATION LIST

Patent Literature

PTL 1
Japanese Unexamined Patent Application, Publication No. 2000-123998
PTL 2
The Publication of Japanese Patent No. 3416249

SUMMARY OF INVENTION

Technical Problem

After electropolishing is performed, a refrigerant tank which stores a refrigerant such as liquid helium for cooling the superconducting accelerating cavity is installed around the main body of the superconducting accelerating cavity. In order to prevent leakage of the refrigerant, etc, this refrigerant tank is installed by firmly joining multiple members by welding, etc., which are arranged so as to cover the circumference of the superconducting accelerating cavity, (e.g., see PTL 2).

The inner surface of the superconducting accelerating cavity after being electropolished is smooth and free of impurities. However, there is a possibility of foreign substances such as dirt entering into the main body of the superconducting accelerating cavity during mounting of an inlet pipe, through which charged particles from the outside are guided, and an outlet pipe, which guides the charged particles to the outside, to the main body of the superconducting accelerating cavity. Once foreign substances such as dirt enter into the main body of the superconducting accelerating cavity, heat generation or electrical discharge is induced, which degrades the performance of the superconducting accelerating cavity. This performance degradation problem can be solved by performing electropolishing again to smooth the inner surface of the main body of the superconducting accelerating cavity.

There is a problem, however/that due to the difficulty of installing electrodes at arbitrary positions on the outer surface of the cavity main body after the refrigerant tank is installed around the main body of the superconducting accelerating cavity, the degree of polishing of electropolishing becomes non-uniform depending on the presence or absence of contact with (contact state of) the electrode. Thus, it is not easy, after installation of the refrigerant tank around the main body of the superconducting accelerating cavity, to electropolish the main body of the superconducting accelerating cavity again to a uniform, degree without removing the refrigerant tank.

Having been made in view of these circumstances, the present invention has an object to provide a superconducting accelerating cavity which can be easily electro-polished again even after installation of a refrigerant tank, and an electropolishing method for a superconducting accelerating cavity.

Solution to Problem

To achieve the above object, the present invention has adopted the following solutions:

The superconducting accelerating cavity according to the present invention includes: a cavity main body formed of a superconducting material into a cylindrical shape; and a refrigerant tank installed around the cavity main body and storing a refrigerant which is supplied from the outside through a supply port into a space created between the refrigerant tank and the outer circumferential surface of the cavity main body, wherein the outer circumferential surface of the cavity main body is coated with a metal material having a higher conductivity than the superconducting material.

In the superconducting accelerating cavity according to the present invention, the refrigerant tank is installed around the cavity main body which is formed of a superconducting material into a cylindrical shape. This refrigerant tank is provided with the supply port through which a refrigerant is supplied from the outside, and anode parts connected to a positive pole of a power source can be inserted into the refrigerant tank through the supply port. Since the outer circumferential surface of the cavity main body is coated with a metal material having a higher conductivity than the superconducting material, bringing the anode parts inserted inside the refrigerant tank into contact with the outer circumferential surface of the cavity main body allows the cavity main body to be uniformly anodized for electropolishing.

Then, a cathode part connected to a negative pole of the power source is inserted inside the cavity main body and the electrolyte is supplied into the cavity main body, so that the inner surface of the cavity main body can be electropolished.

Thus, according to the superconducting accelerating cavity of the present invention, it is possible to provide a superconducting accelerating cavity which can be easily electropolished again even after installation of the refrigerant tank.

In a superconducting accelerating cavity of a first aspect of the present invention, the cavity main body has a shape formed by large diameter portions and small diameter portions, which are at a shorter distance to the central axis of the cavity main body than the large diameter portions, being alternately formed along the axial direction, and the position of the supply port in the axial direction corresponds to the position of the large diameter portion in the axial direction.

In this way, the anode parts which are inserted from the supply port can foe easily brought into contact with the large diameter portion of the cavity main body which is disposed at the position close to the supply port of the refrigerant tank.

In a superconducting accelerating cavity of a second aspect of the present invention, the cavity main body has a shape formed by large diameter portions and small diameter portions, which are at a shorter distance to the central axis of the cavity main body than the large diameter portions, being alternately formed along the axial direction, and the coating thickness of the metal material in the large diameter portions is larger than the coating thickness of the metal material in the small diameter portions.

In this way, current can flow more easily in the large diameter portions which are farther away from the central axis of the cavity main body, in which the cathode is disposed during electropolishing, than in the small diameter portions which are closer to the central axis. Thus, the defect of the degree of polishing of electropolishing becoming non-uniform on the inner surface of the cavity main body can be suppressed.

In the superconducting accelerating cavity of the second aspect of the present invention, the ratio between the distance to the central axis of the large diameter portions and the distance to the central axis of the small, diameter portions/and the ratio between the coating thickness in the large diameter portions and the coating thickness in the small diameter portions may substantially correspond to each other.

In this way, the coating thickness in the large diameter portions and the coating thickness in the small diameter portions of the cavity main body can be adjusted to a proper coating thickness according to the distance from the central axis of the cavity main body in which the cathode is disposed during electropolishing.

An electropolishing method for a superconducting accelerating cavity of the present invention is an electropolishing method for a superconducting accelerating cavity which includes: a cavity main body formed of a superconducting material into a cylindrical shape; and a refrigerant tank installed around the cavity main body and storing a refrigerant which is supplied from the outside through a supply port into a space created between the refrigerant tank and the outer circumferential surface of the cavity main body, the outer circumferential surface of the cavity main body being coated with a metal material having a higher conductivity than the superconducting material, wherein the electropolishing method includes: inserting an anode part which is connected to a positive pole of a power source through the supply port and bringing the anode part into contact with the outer circumferential surface of the cavity main body; inserting a cathode part which is connected to a negative pole of the power source into the cavity main body; supplying an electrolyte into the cavity main body; and starting energization by the power source and electropolishing the inner surface of the cavity main body.

According to the electropolishing method of the present invention, since the outer circumferential surface of the cavity main body is coated with a metal material having a higher conductivity than the superconducting material, bringing the anode part into contact with the outer circumferential surface of the cavity main body by the anode installation step allows the cavity main body to be uniformly anodized for electropolishing.

Then, the cathode part connected to the negative pole of the power source is inserted inside the cavity main body by the cathode installation step and the electrolyte is supplied into the cavity main body by the supply step, so that the inner surface of the cavity main body can be electropolished.

Thus, according to the electropolishing method for a superconducting accelerating cavity of the present invention, it is possible to provide an electropolishing method for a superconducting accelerating cavity by which electropolishing can be easily performed again even after installation of the refrigerant tank.

In an electropolishing method for a superconducting accelerating cavity of a first aspect of the present invention, the cavity main body has a shape formed by large diameter portions and small diameter portions, which are at a shorter distance to the central axis of the cavity main body than the large diameter portions, being alternately formed along the axial direction, and the position of the supply port in the axial direction corresponds to the position of the large diameter portion in the axial direction.

In this way, the anode part which is inserted from the supply port can be easily brought into contact with the large diameter portion of the cavity main body which is disposed at the position close to the supply port of the refrigerant tank.

In an electropolishing method for a superconducting accelerating cavity of a second aspect of the present invention, the cavity main body has a shape formed by large diameter portions and small diameter portions, which are at a shorter distance to the central axis of the cavity main body than the large diameter portions, being alternately formed along the axial direction, and the coating thickness of the metal material in the large diameter portions is larger than the coating thickness of the metal material in the small diameter portions.

In this way, current can flow more easily in the large diameter portions which are farther away from the central axis of the cavity main body, in which the cathode is disposed during electropolishing, than in the small diameter portions which are closer to the central axis. Thus, the defect of the degree of polishing of electropolishing becoming non-uniform on the inner surface of the cavity main body can be suppressed.

In an electropolishing method for a superconducting accelerating cavity of a third aspect of the present invention, the ratio between the distance to the central axis of the large diameter portions and the distance to the central axis of the small diameter portions, and the ratio between the coating thickness in the large diameter portions and the coating thickness in the small diameter portions may substantially correspond to each other.

In this way, the coating thickness in the large diameter portions and the coating thickness in the small diameter portions of the cavity main body can be adjusted to a proper coating thickness according to the distance from the central axis of the cavity main body in which the cathode is disposed during electropolishing.

Advantageous Effects of Invention

According to the present invention, it is possible to provide a superconducting accelerating cavity which can be easily electropolished again even after installation of a refrigerant tank, and an electropolishing method for a superconducting accelerating cavity.

DESCRIPTION OF EMBODIMENTS

First Embodiment

Figure 1:
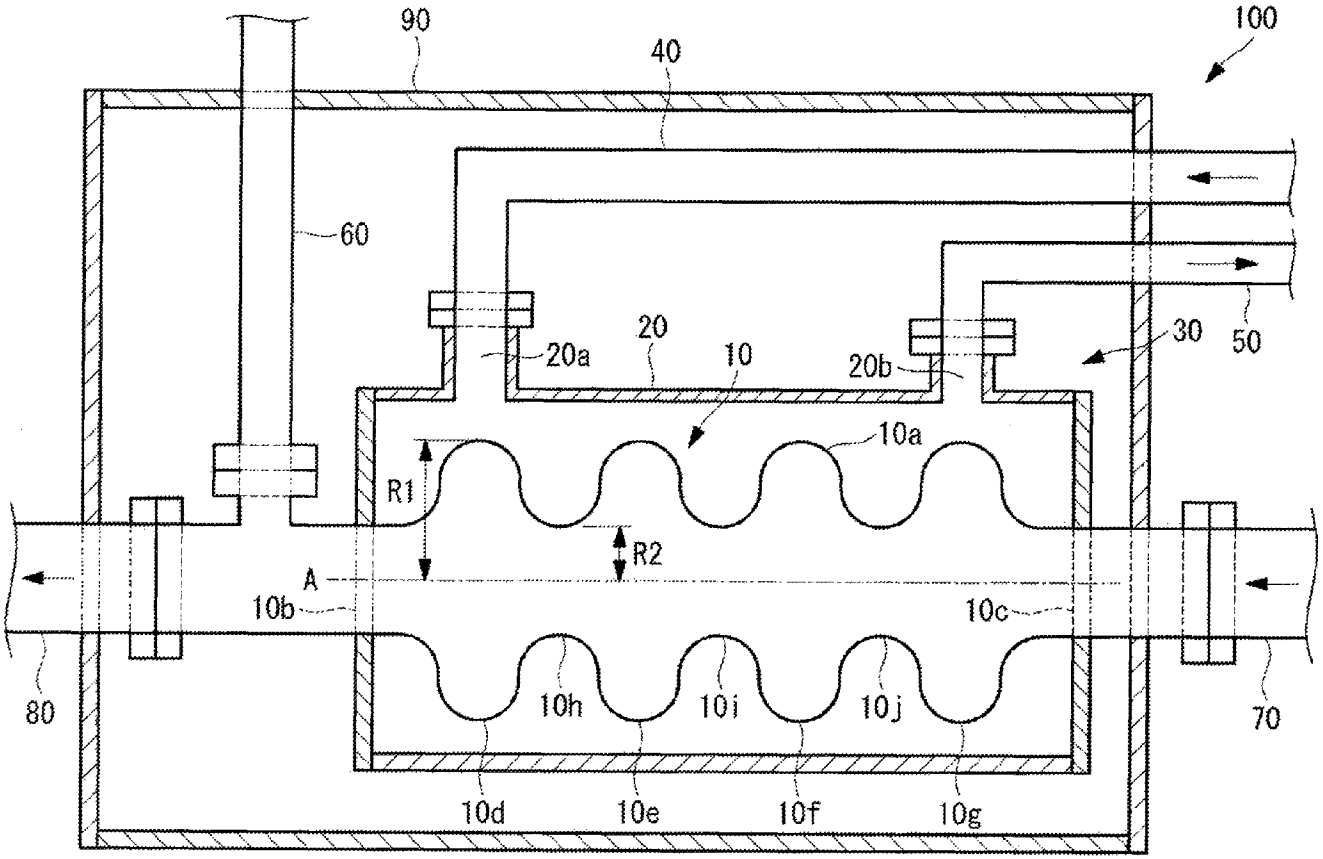
FIG. 1 is a longitudinal cross-sectional view showing the configuration of a superconducting accelerator of a first embodiment of the present invention.

In the following, a superconducting accelerator 100 of a first embodiment of the present invention will be described by using FIG. 1. FIG. 1 is a longitudinal cross-sectional view showing the configuration of the superconducting accelerator of the first embodiment of the present invention.

In FIG. 1, the superconducting accelerator 100 includes a superconducting accelerating cavity 30, and a vacuum vessel 90 housing the superconducting accelerating cavity 30. The superconducting accelerating cavity 30 includes a cavity main body 10 formed of a superconducting material such as niobium (Nb) into a cylindrical shape, and a refrigerant tank 20 installed around the cavity main body 10. The refrigerant tank 20 stores a refrigerant which is supplied from the outside through a supply port 20*a* into a space created between the refrigerant tank and the outer circumferential surface of the cavity main body 10. As the refrigerant, for example, liquid helium is used.

The outer circumferential surface of the cavity main body 10 is coated with a metal material having a higher conductivity than the superconducting material. This coated part forms a metal coating layer 10*a*. As the metal material having a high conductivity, for example, copper, gold, silver, or aluminum is used. The reason for coating the outer circumferential surface of the cavity main body 10 with a metal material having a high conductivity is, as described later, to make the cavity main body 10 function as an anode during electropolishing. In this embodiment, the coating thickness of the metal coating layer 10*a* shall be substantially constant regardless of the position in the direction of the central axis of the cavity main body 10. A constant coating thickness of the metal coating layer 10*a* allows a substantially constant potential to be applied to the entire cavity main body 10.

The cavity main body 10 have equatorial portions (large diameter portions) 10*d*, 10*e*, 10*f*, and 10*g* at a distance R1 from a central axis A. In addition, the cavity main body 10 have iris portions (small diameter portions) 10*h*, 10*i*, and 10*j* at a distance R2 from the central axis A. As shown in FIG. 1, the distance R2 to the central axis A of the iris portions 10*h*, 10*i*, and 10*j* is shorter than the distance R1 to the central axis A of the equatorial portions 10*d*, 10*e*, 10*f*, and 10*g*. As shown in FIG. 1, the cavity main body 10 has a shape formed, by the equatorial portions 10*d*, 10*e*, 10*f*, and 10*g*, and the iris portions 10*h*, 10*i*, and 10*j* being alternately formed along the direction of the central axis A.

Since the refrigerant is stored in the refrigerant tank 20, the refrigerant tank 20 and the cavity main body 10 are firmly joined by welding, etc. at areas contacting with each other. Due to such a structure, it is difficult to remove the refrigerant tank 20 from the cavity main body 10 after the refrigerant tank 20 is joined to the cavity main body 10.

The supply port 20*a* is connected with a supply pipe 40 which supplies the refrigerant. The supply pipe 40 is a pipe for supplying the refrigerant, which is supplied from an external refrigerant tank (not shown), to the supply port 20*a*. Liquid helium supplied from the supply pipe 40 and stored in the refrigerant tank 20 is used for cooling the cavity main body 10 to an ultralow temperature and keep the cavity main body in a superconducting state.

Part of the liquid helium stored in the refrigerant tank 20 absorbs the heat generated in the cavity main body 10 and is gasified into a helium gas. The helium gas is discharged from a discharge port 20*b* to the outside of the superconducting accelerating cavity 30, and is discharged to the outside of the superconducting accelerator 100 through a discharge pipe 50. The helium gas discharged to the outside is reliquefied by being compressed by a compressor (not shown.) and returned to the refrigerant tank.

The position of the supply port 20*a* of the refrigerant tank 20 in the direction of the central axis A corresponds to the position of the equatorial portion 10*d*. In addition, the position of the discharge port 20*b* of the refrigerant tank 20 corresponds to the position of the equatorial portion 10*g*. The reason for this arrangement is, as described later, to make it easier to bring anode parts 230 and 240 to be inserted from the supply port 20*a* and the discharge port 20*b* into contact with the metal coating layer 10*a* formed on the outer circumferential surface of the cavity main body 10 when the cavity main body 10 is made to function as an anode for electropolishing.

The cavity main body 10 is provided with an inlet part 10*c* and an outlet part 10*b*, which are openings, at both ends in the direction of the central axis. The inlet part 10*c* is connected with an inlet pipe 70 through which charged particles from the outside are guided, and the inlet part 10*c* guides the charged particles guided through the inlet pipe 70 to the cavity main body 10. The outlet part 10*b* is connected with an outlet pipe 80 which guides the charged particles to the outside, and the outlet part 10*b* guides the charged particles accelerated in the cavity main body 10 to the outlet pipe 80.

A waveguide 60, which is provided so as to foe connected with the outlet part 10*b* of the cavity main body 10, is a pipe for introducing high-frequency power generated by a high frequency source (not shown) such as a klystron into the cavity main body 10. When high-frequency power is input from the outside through the waveguide 60, a positive electrode and a negative electrode are generated on the inner surface of the cavity main body 10, and an accelerating electric field for accelerating the charged particles is produced.

The superconducting accelerating cavity 30 is disposed inside the vacuum vessel 90. The inside of the vacuum vessel 90 is maintained in a substantially vacuum state by a vacuum device (not shown), and the vacuum vessel 90 prevents external heat from transferring to the superconducting accelerating cavity 30.

Figure 2:
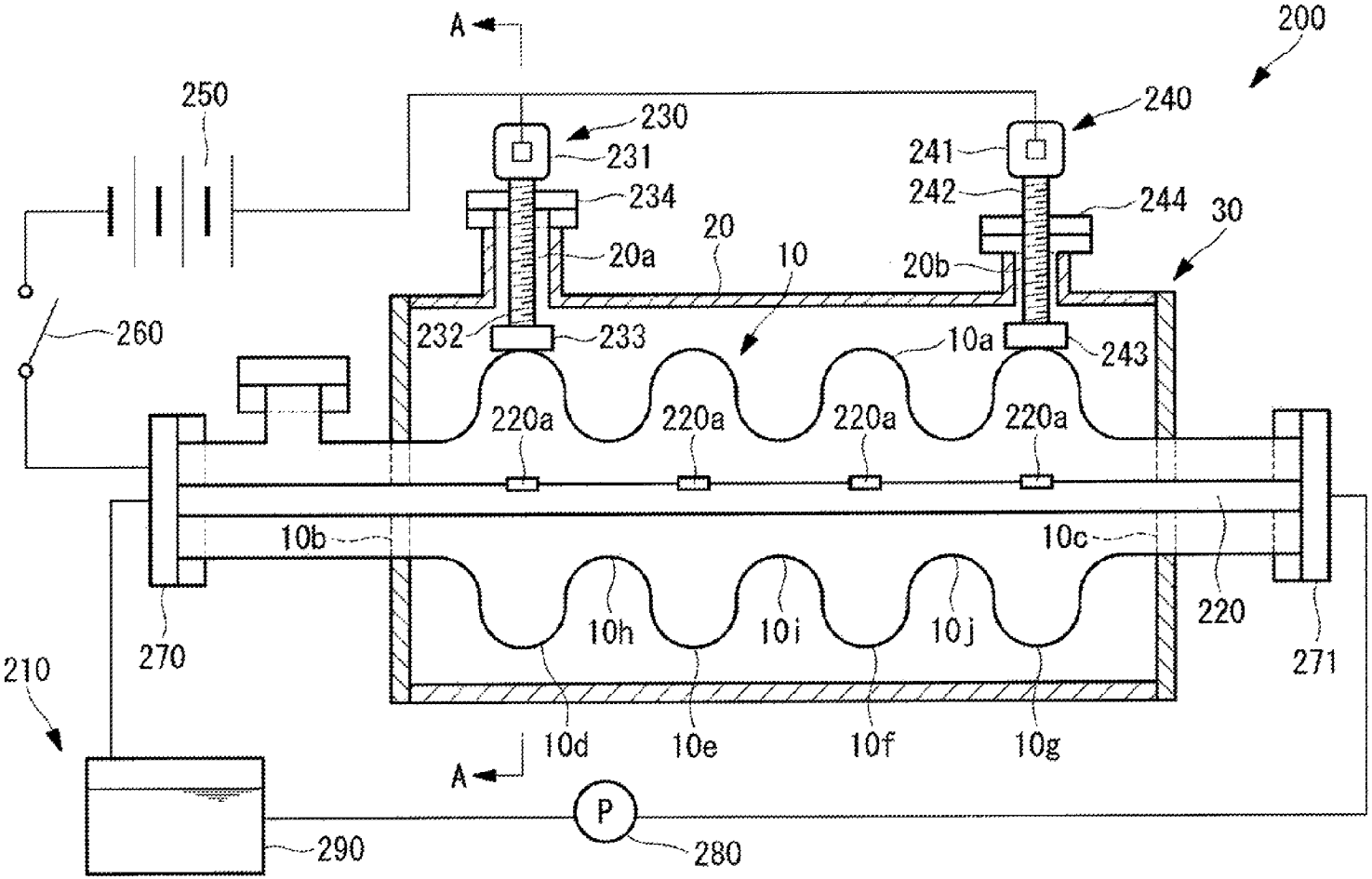
FIG. 2 is a longitudinal cross-sectional view showing a superconducting accelerating cavity and an electropolishing device of the first embodiment of the present invention.
Figure 7:
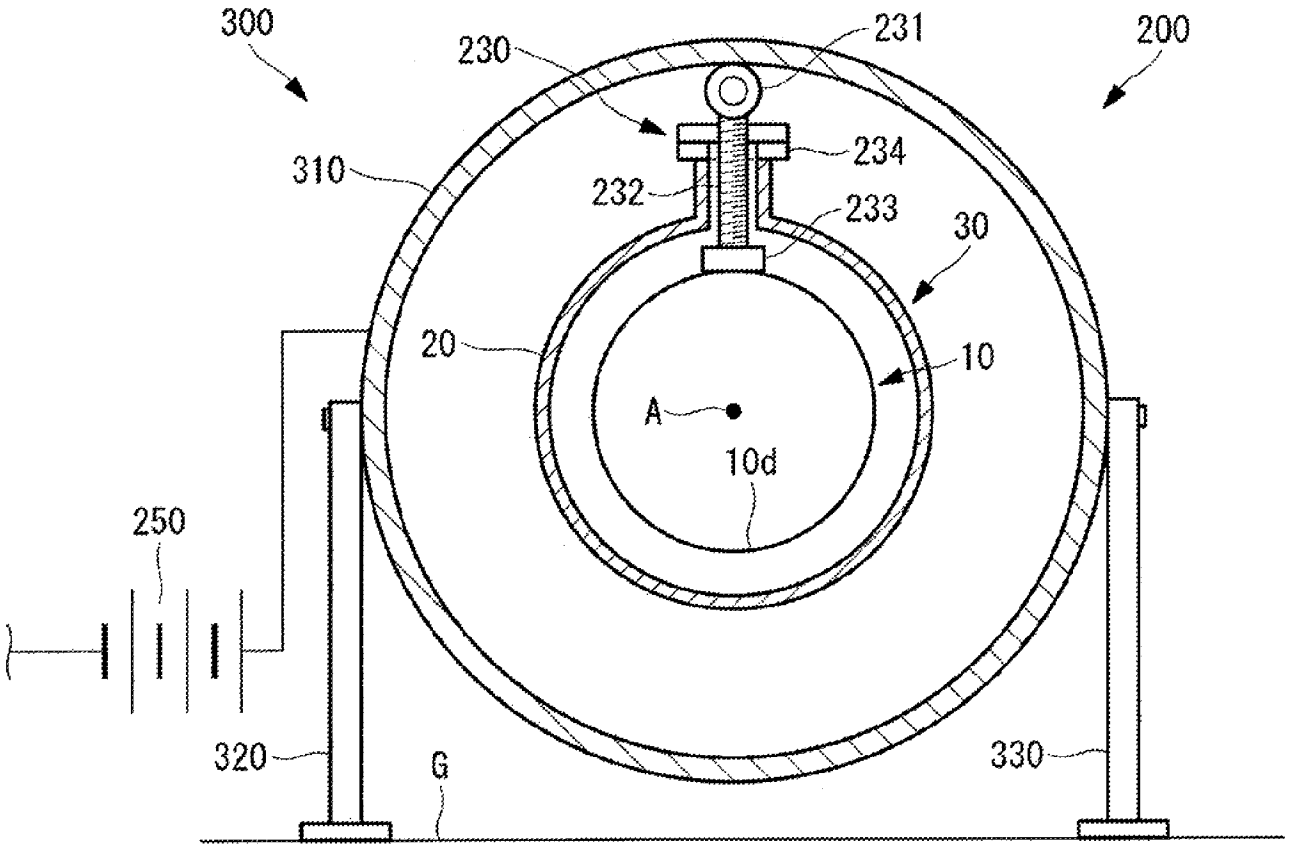
FIG. 7 is a cross-sectional view along the arrow A-A of the superconducting accelerating cavity and the electropolishing device shown in FIG. 2.

Next, an electropolishing device 200 of this embodiment will be described by using FIG. 2. FIG. 2 is a longitudinal cross-sectional view showing the superconducting accelerating cavity 30 and the electropolishing device 200 of this embodiment. The electropolishing device 200 is constituted of the parts excluding the superconducting accelerating cavity 30 shown in the configuration of FIG. 2. In FIG. 2, a pair of rotation holding tools 300 which is shown in FIG. 7 and described later is not shown.

The electropolishing device 200 includes: an electrolyte supply device 210 which circulates the electrolyte inside the cavity main body 10; a cathode part 220 disposed inside the cavity main body 10; the anode part 230 inserted in the supply port 20*a* of the refrigerant tank 20; and the anode part 240 inserted in the discharge port 20*b* of the refrigerant tank 20. The cathode part 220 is connected to the negative pole of the power source 250, while the anode parts 230 and 240 are connected to the positive pole of the power source 250. The current supply from the power source 250 to each electrode can be switched on and off by the switch 260.

Caps 270 and 271 for preventing leakage of the electrolyte are attached to the respective ends of the cavity main body 10. The cathode part 220, which is a hollow cylindrical member, is supported by the cap 270 and the cap 271 at both ends so as to be disposed coaxially with the central axis of the cavity main body 10. Actuating a pump 280 causes the electrolyte inside a tank 290 to be supplied into the cathode part 220 through the cap 270. As the electrolyte, various electrolytes can be used; for example, hydrogen fluoride, sulfuric acid, etc. are used.

The cathode part 220 which is a hollow cylindrical member is provided with multiple openings 220*a*. The electrolyte flowing inside the cathode part 220 flows out through the multiple openings 220*a* into the cavity main body 10, and the electrolyte is supplied into the cavity main body 10. The electrolyte which flows inside the cathode part 220 without flowing out through the openings 220*a* is returned via the cap 271 to the tank 290.

The anode part 230 is constituted of a cable connection part 231, a rod part 232, a contact part 233, and a cap 234, Each member constituting the anode part 230 is constituted of a metal having a high conductivity such as copper. Each member constituting the anode part 230 is substantially at the same potential as the positive pole of the power source 250.

A cable coupled with the positive pole of the power source 250 is connected to the cable connection part 231. The cable connection part 231 is coupled with the rod part 232, and the rod part 232 is coupled with the contact part 233. The rod part 232 is a rod-like member with a male thread formed on the outer circumferential surface, and is engaged with a female thread formed on the inner circumferential surface of a hole provided at the center part of the cap 234. The cap 234 is fastened with a bolt to a flange which is provided at the supply port 20*a* of the refrigerant tank 20.

Rotating the cable connection part 231 coupled with the rod part 232 causes the rod part 232 to move in the axial direction of the rod part 232 relative to the cap 234. In accordance with this movement, the contact part 233 coupled with the leading end of the rod part 232 is moved closer to or away from the metal coating layer 10*a* provided on the outer circumferential surface of the equatorial portion 10*d* of the cavity main body 10.

Fastening the cap 234 with a bolt to the flange provided at the supply port 20*a* of the refrigerant tank 20 and rotating the cable connection part 231 can bring the contact part 233 gradually closer to the metal coating layer 10*a*. The contact part 233 is adjusted so as to come into contact with the metal coating layer 10*a* provided on the outer circumferential surface of the equatorial portion 10*d* of the cavity main body 10. In this way, the positive pole of the power source 250 and the metal coating layer 10*a* are electrically connected, so that the metal coating layer 10*a* functions as an anode for electropolishing.

The anode part 240 is constituted of a cable connection part 241, a rod part 242, a contact part 243, and a cap 244. Each member constituting the anode part 240 is constituted of a metal having a high conductivity such as copper. Each member constituting the anode part 240 is substantially at the same potential as the positive pole of the power source 250.

A cable coupled with the positive pole of the power source 250 is connected to the cable connection part 241. The cable connection part 241 is coupled with the rod part 242, and the rod part 242 is coupled with the contact part 243. The rod part 242 is a rod-like member with a male thread formed on the outer circumferential surface, and is engaged with a female thread formed on the inner circumferential surface of a hole provided at the center part of the cap 244. The cap 244 is fastened with a bolt to a flange provided at the discharge port 20*b* of the refrigerant tank 20.

Rotating the cable connection part 241 coupled with the rod part 242 causes the rod part 242 to move in the axial direction of the rod part 242 relative to the cap 244. In accordance with this movement, the contact part 243 coupled with the leading end of the rod part 242 is moved closer to or away from the metal coating layer 10*a* provided on the outer circumferential surface of the equatorial portion 10*g* of the cavity main body 10.

Fastening the cap 244 with a bolt to the flange provided at the discharge port 20*b* of the refrigerant tank 20 and rotating the cable connection part 241 can bring the contact part 243 gradually closer to the metal coating layer 10*a*. The contact part 243 is adjusted so as to come into contact with the metal coating layer 10*a* provided on the outer circumferential surface of the equatorial portion 10*g* of the cavity main body 10. In this way, the positive pole of the power source 250 and the metal coating layer 10*a* are electrically connected, so that the metal coating layer 10*a* functions as an anode for electropolishing.

As shown in FIG. 7, the electropolishing device 200 includes the pair of rotation holding tools 300 which rotatably holds the superconducting accelerating cavity 30 around the central axis A, and a rotation device (not shown) which rotates the superconducting accelerating cavity 30, which is held by the rotation holding tools 300, around the central axis A. FIG. 7 is a cross-sectional view along the arrow A-A of the superconducting accelerating cavity 30 and the electropolishing device 200 shown in FIG. 2.

The rotation holding tool 300 includes an annular rail part 310 disposed in a plane perpendicular to the central axis A, and support parts 320 and 330 supporting the rail part 310 against a ground surface G. The support parts 320 and 330 fix the rail part 310 relative to the ground surface G. Although FIG. 7 shows the rotation holding tool 300 which is present at the position of the anode part 230, the other rotation holding tool 300 is present at the position of the anode part 240.

Thus, the superconducting accelerating cavity 30 is held relative to the ground surface G by the pair of rotation holding tools 300 disposed at the position of the anode part 230 and the position of the anode part 240. The superconducting accelerating cavity 30 held by the pair of rotation holding tools 300 is rotated around the central axis A by the rotation device (not shown).

The rotation device includes a motor (not shown) which rotates a gear coupled with another gear (not shown) provided on the outer circumferential surface of the superconducting accelerating cavity 30. Rotating the motor causes the superconducting accelerating cavity 30 to rotate around the central axis A.

The cable connection part 231 of the anode part 230 is a rotating member which rotates while being engaged with the rail part 310. In addition, the cable connection part 231 is electrically connected with the positive pole of the power source 250, which is connected to the outer circumferential surface of the rail part 310, through the conductive rail part 310.

Thus, rotating the superconducting accelerating cavity 30 allows the electrolyte to spread over the entire inner surface of the cavity main body 10, so that the inner surface is uniformly electropolished.

Figure 3:
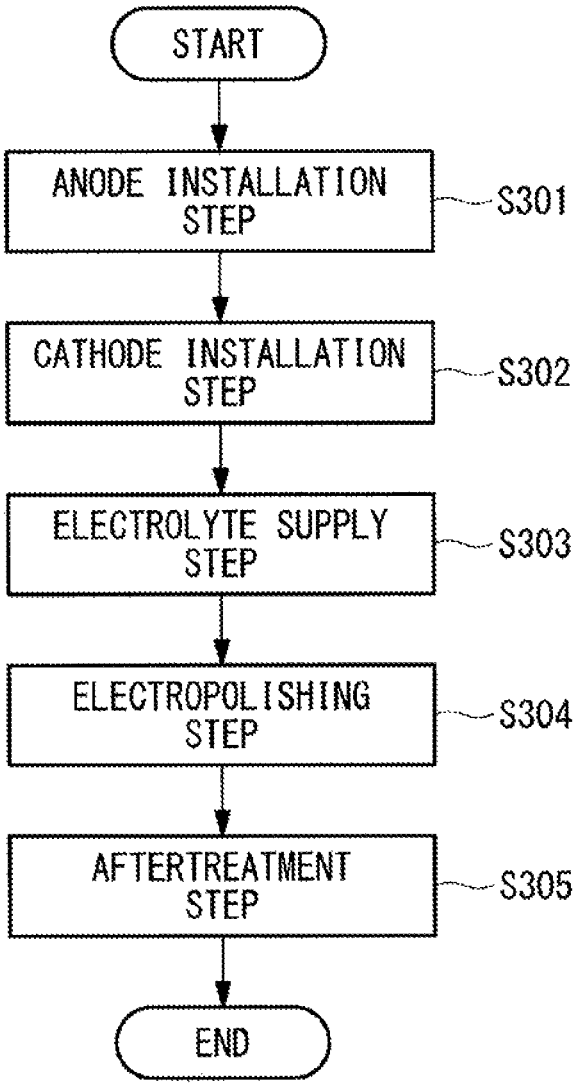
FIG. 3 is a flowchart showing an electropolishing method for a superconducting accelerating cavity of the first embodiment of the present invention.

Next, an electropolishing method of this embodiment will be described by using FIG. 3. FIG. 3 is a flowchart showing the electropolishing method for the superconducting accelerating cavity 30 of this embodiment. The electropolishing method of this embodiment is performed in such a case where, after the superconducting accelerating cavity 30 is integrated into the superconducting accelerator 100 shown in FIG. 1 and the superconducting accelerator 100 is operated, inclusion of foreign substances inside the superconducting accelerating cavity 30 is suspected as a result of a measurement.

The superconducting accelerating cavity 30 is supposed to be removed to the outside of the vacuum vessel 90 from the superconducting accelerator 100 shown in FIG. 1 before the electropolishing method of this embodiment is performed.

Step S301 is an anode installation step of installing the anode part 230 in the supply port 20*a* of the refrigerant tank 20 and installing the anode part 240 in the discharge port 20*b* of the refrigerant tank 20. The anode part 230 is installed in the supply port 20*a*, and the cable connection part 231 is rotated to adjust the position of the contact part 233, and the contact part 233 is brought into contact with the metal coating layer 10*a* of the cavity main body 10. In the same way, the anode part 240 is installed in the discharge port 20*b*, and the cable connection part 241 is rotated to adjust the position of the contact part 243, and the contact part 243 is brought into contact with the metal coating layer 10*a* of the cavity main body 10.

Thus, the anode installation step S301 is a step of inserting the anode part 230, which is connected to the positive pole of the power source 250, from the supply port 20*a* and bringing the anode part 230 into contact with the metal coating layer 10*a* on the outer circumferential surface of the cavity main body 10. In addition, the anode installation step 3301 is a step of inserting the anode part 240, which is connected to the positive pole of the power source 250, from the discharge port 20*b* and bringing the anode part 240 into contact with the metal coating layer 10*a* on the outer circumferential surface of the cavity main body 10. Performing the anode installation step S301 causes the positive pole of the power source 250 and the metal coating layer 10*a* to be electrically connected, so that the metal coating layer 10*a* functions as an anode for electropolishing.

Step S302 is a cathode installation step of installing the cathode part 220 coaxially with the central axis of the cavity main body 10. The cathode part 220 is inserted into the cavity main body 10, and the cap 270 is installed at the outlet part 10*b* of the cavity main body 10, while the cap 271 is installed at the inlet part 10*c* of the cavity main body 10, and thereby the cathode part 220 is installed coaxially with the central axis of the cavity main body 10. After the cathode part 220 is installed, the caps 270 and 271 are connected with the pipe of the electrolyte supply device 210 so that the electrolyte can be supplied by the electrolyte supply device 210. In addition, the negative pole of the power source 250 and the cathode part 220 are electrically connected so that the cathode functions as a cathode for electropolishing.

Step S303 is an electrolyte supply step of supplying the electrolyte into the cavity main body 10. The pump 280 of the electrolyte supply device 210 is driven and the electrolyte inside the tank 290 is supplied to the cathode part 220, and thereby the electrolyte is supplied through the openings 220*a* into the cavity main body 10. When the amount of electrolyte supplied into the cavity main body 10 has reached a predetermined amount, driving of the pump 280 is stopped to stop the electrolyte supply to the cavity main body 10.

Step S304 is an electropolishing step of electropolishing the cavity main body 10 in which the anode parts 230 and 240 and the cathode part 220 are installed and the electrolyte is supplied to the inside. In step S304, the switch 260 is switched, from the off state to the on state. Switching the switch 260 to the on state brings the anode parts 230 and 240 to the same potential as the positive pole of the power source 250, and the cathode part 220 to the same potential as the negative pole of the power source 250, turning the cathode part into a cathode.

Since the anode parts 230 and 240 are in contact with the metal coating layer 10*a* on the outer circumferential surface of the cavity main body 10, the entire metal coating layer 10*a* functions as an anode. Since the cathode part 220 is constituted of a conductive metal material over the entire length in the axial direction, the cathode part 220 functions as a cathode over the entire length in the axial direction. Thus, current flows through the electrolyte between the cathode part 220 and the inner circumferential surface of the cavity main body 10 over the entire length of the cathode part 220 in the axial direction, causing electrolysis of the electrolyte. The inner circumferential surface of the cavity main body 10 is polished due to this electrolysis.

While the electropolishing step S304 is in progress, the superconducting accelerating cavity 30 is kept rotating around the axis by the rotation device. Rotating the superconducting accelerating cavity 30 allows the electrolyte to spread over the entire inner surface of the cavity main body 10, so that the inner surface is uniformly electropolished. The amount of polishing achieved in the electropolishing step S304 can be adjusted by adjusting the output voltage of the power source 250 or the time of electropolishing, and the amount of polishing is, for example, set to approximately 100 μm.

Step S305 is an aftertreatment step which is performed after the electropolishing step S304. The aftertreatment step includes treatment of discharging the electrolyte remaining inside the cavity main body 10 to the outside, and cleaning treatment of cleaning the inner circumferential surface of the cavity main body 10 with hydrogen peroxide water or ultrapure water. In addition, the aftertreatment step S305 includes treatment of removing the anode parts 230 and 240 and the cathode part 220 from the superconducting accelerating cavity 30.

After the aftertreatment step S305, the electropolished superconducting accelerating cavity 30 is installed back into the vacuum vessel 90 to make the superconducting accelerator 100 usable again.

Figure 4:
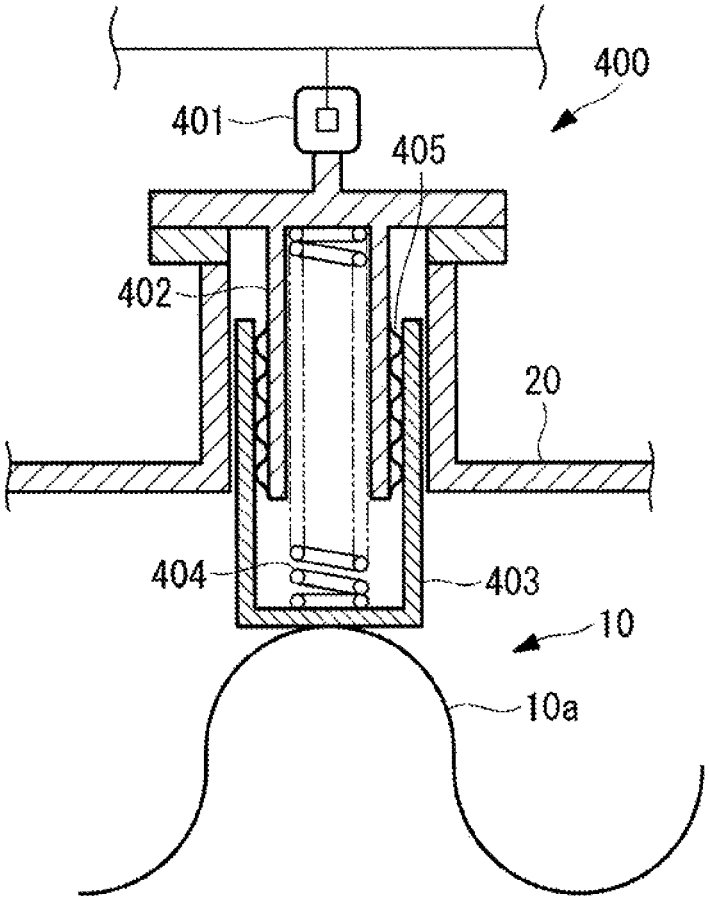
FIG. 4 is a view showing a modified example of an anode part installed, in a refrigerant tank.

Next, a modified example of the anode parts 230 and 240 will be described by using FIG. 4. FIG. 4 is a view showing the modified example of the anode part installed in the refrigerant tank 20, and is an enlarged view of the cross-section of the superconducting accelerating cavity 30 viewed from the front side. The anode parts 230 and 240 described above are adapted such that the positions of the contact parts 233 and 243 are adjusted by means of the male thread provided on the outer circumferential surfaces of the rod parts 232 and 242. In contrast, an anode part 400 shown in FIG. 4 is adapted such that the position of a contact part 403 is adjusted by means of the elastic force of a coil spring 404.

As shown in FIG. 4, the anode part 400 of the modified example is constituted of a cable connection part 401, a cap 402, a contact part 403, the coil spring 404, and a metal spring 405. Each member constituting the anode part 400 is constituted of a highly conductive metal such as copper. Each member constituting the anode part 400 is substantially at the same potential as the positive pole of the power source 250.

A cable coupled with the positive pole of the power source 250 is connected to the cable connection part 401. The cable connection part 401 is coupled with the cap 402. The cap 402 is fastened with a bolt to the flange provided at the supply port 20*a* or the discharge port 20*b* of the refrigerant tank 20. The cap 402 is provided with a cylindrical portion, and the coil spring 104 having substantially the same diameter as the inner diameter of this cylindrical portion is inserted into the cylindrical portion.

The cylindrical contact part 403 having a larger inner diameter than the outer diameter of the cylindrical portion of the cap 402 is disposed around the cylindrical portion. A biasing force in the direction of bringing the contact part 403 into contact with the metal coating layer 10*a* of the cavity main body 10 is applied to the contact part 403 by the coil spring 404 which is inserted in the cylindrical portion of the cap 402.

A metal spring 405 is provided between the outer circumferential surface of the cylindrical portion of the cap 402 and the inner circumferential surface of the contact part 403. The metal spring 405 allows the outer circumferential surface of the cylindrical portion of the cap 402 and the inner circumferential surface of the contact part 403 to be electrically connected with each other and reliably energized. The biasing force applied by the coil spring 404 causes the contact part 403 to be disposed in contact with the metal coating layer 10*a* of the cavity main body 10. Thus, the positive pole of the power source 250 and the metal coating layer 10*a* are electrically connected, so that the metal coating layer 10*a* functions as an anode for electropolishing.

Figure 5:
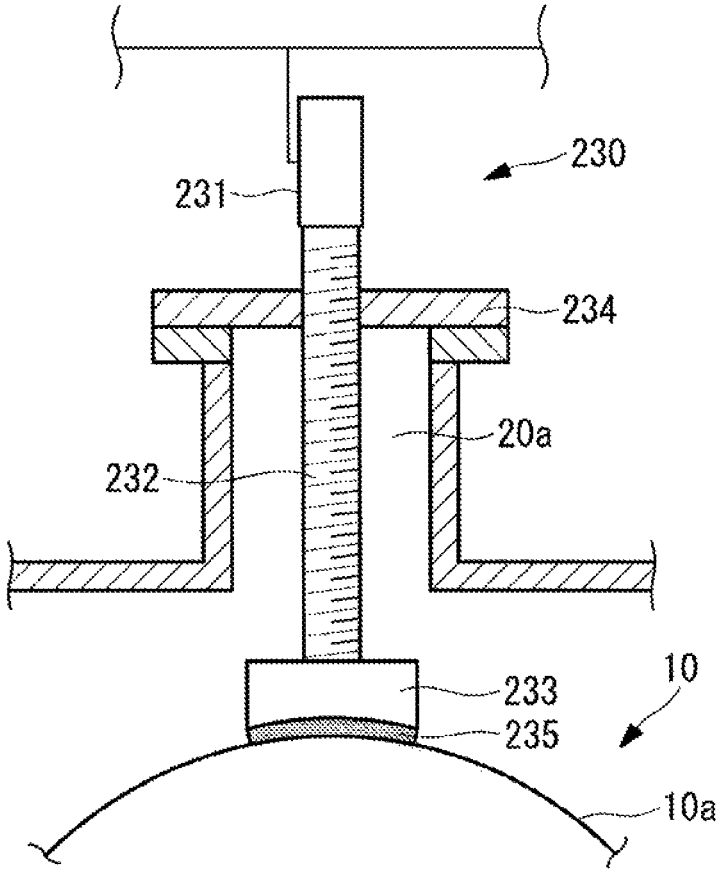
FIG. 5 is a view showing another modified example of the anode part installed in the refrigerant tank.

Next, another modified example of the anode parts 230 and 240 will be described by using FIG. 5. FIG. 5 is a view showing the another modified example of the anode part installed in the refrigerant tank 20, and is an enlarged view of the cross-section of the superconducting accelerating cavity 30 viewed from the side surface (in the direction of the central axis). Description of the anode part 230 shown in FIG. 5, which is the same as the anode part 230 described in FIG. 2, will be omitted. FIG. 5 differs from FIG. 2 in that a contact point member 235 is added.

The contact point member 235 is provided at the leading end of the contact part 233, and is a member for improving the electrical contact between the contact part 233 and the metal coating layer 10*a*. As the contact point member 235, various materials, such as plain-knitted copper wire or a copper leaf spring, etc., which can enhance electrical contact can be used. The provision of the contact point member 235 makes it possible to improve the electrical contact between the contact part 233 and the metal coating layer 10*a* so that the metal coating layer 10*a* can more reliably function as an anode for electropolishing.

The contact point member 235 may also be provided at the leading end of the contact part 403 of the anode part 400 of the above-described modified example.

As has been described above, in the superconducting accelerating cavity 30 of this embodiment, the outer circumferential surface of the cavity main body 10 is coated, with the metal coating layer 10*a* having a higher conductivity than the superconducting material. Thus, according to the electropolishing method for the superconducting accelerating cavity 30 of this embodiment, bringing the anode parts 230 and 240 into contact with the outer circumferential surface of the cavity main body 10 by the anode installation step S301 allows the cavity main body 10 to be uniformly anodized for electropolishing.

Then, the cathode part 220 which is connected to the negative pole of the power source 250 is inserted into the cavity main body 10 by the cathode installation step S301, and the electrolyte is supplied into the cavity main body 10 by the electrolyte supply step S303, so that the inner circumferential surface of the cavity main body 10 can be electropolished.

Thus, according to the electropolishing method for the superconducting accelerating cavity 30 of this embodiment, it is possible to provide an electropolishing method for a superconducting accelerating cavity by which electropolishing can be easily performed again even after installation of the refrigerant tank 20.

The superconducting accelerating cavity 30 of this embodiment has a shape formed by the equatorial portions (large diameter portions) 10*d*, 10*e*, 10*f*, and 10*g*, and the iris portions (small diameter portions) 10*h*, 10*i*, and 10*j*, which are at a shorter distance to the central axis A than the equatorial portions 10*d*, 10*e*, 10*f*, and 10*g*, being alternately formed along the axial direction. In addition, the position of the refrigerant supply port 20*a* in the axial direction corresponds to the position of the equatorial portion 10*d* in the axial direction. Moreover, the position of the refrigerant discharge port 20*b* in the axial direction corresponds to the position of the equatorial portion 10*g* in the axial direction.

In this way, the anode part 230 inserted from the supply port 20*a* can be easily brought into contact with the equatorial portion 10*d* of the cavity main body 10 which is disposed at the position close to the supply port 20*a* of the refrigerant tank 20. In addition, the anode part 240 inserted from the discharge port 20*b* can be easily brought into contact with the equatorial portion 10*g* of the cavity main body 10 disposed at the position close to the discharge port 20*b* of the refrigerant tank 20.

Second Embodiment

Figure 6:
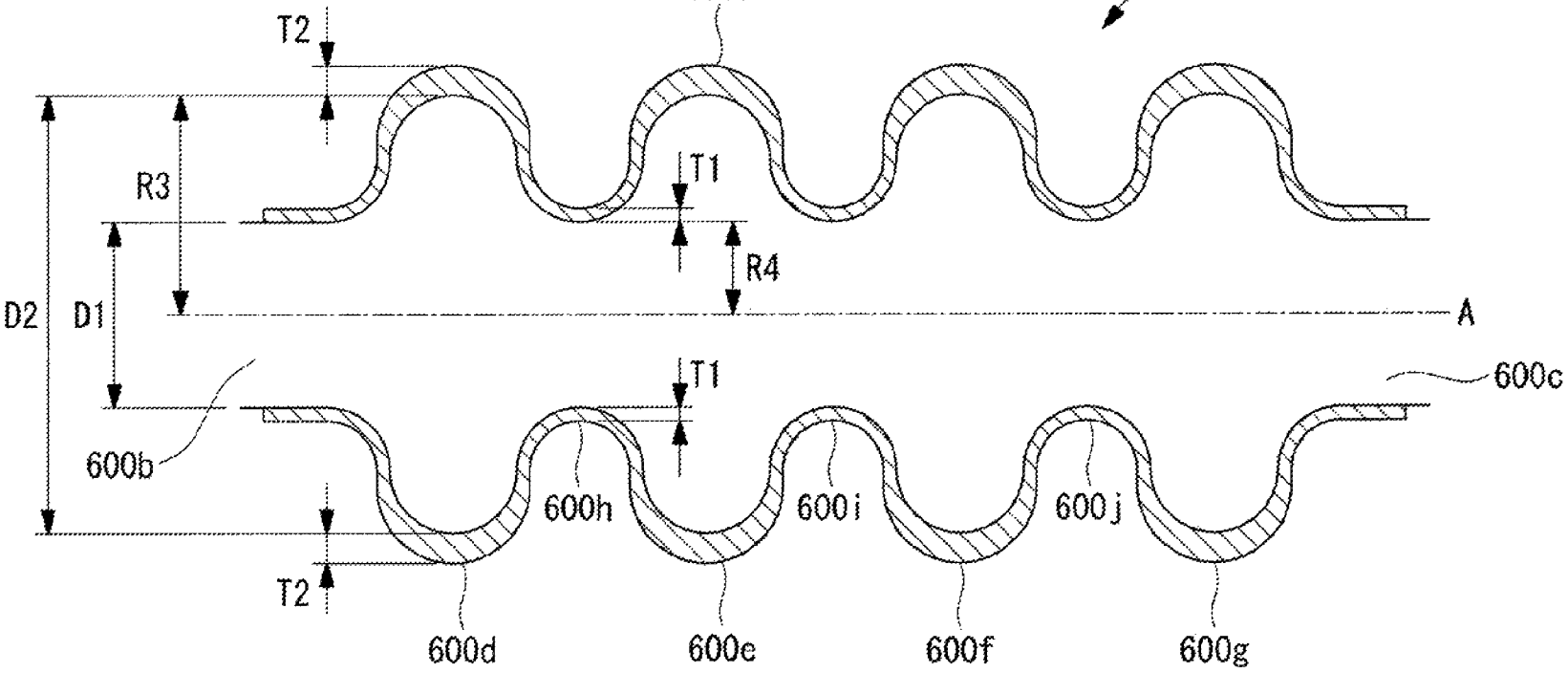
FIG. 6 is a view showing a cavity main body of a superconducting accelerating cavity of a second embodiment of the present invention.

In the following, a cavity main body 600 of a superconducting accelerator of a second embodiment will be described by using FIG. 6. FIG. 6 is a view showing the cavity main body 600 of a superconducting accelerating cavity of the second embodiment of the present invention. Although the refrigerant tank is provided around the cavity main body 600, the refrigerant tank is not shown in FIG. 6.

The second embodiment is a modified example of the first embodiment; unless otherwise described in the following, the second, embodiment is the same as the first embodiment, and description thereof will be omitted.

The coating thickness of the metal coating layer 10*a* of the first embodiment is substantially constant regardless of the position in the direction of the central axis of the cavity main body 10. In contrast, the coating thickness of a metal coaxing layer 600*a* of the second embodiment varies depending on the position in the direction of the central axis A of the cavity main body 600.

The cavity main body 600 shown in FIG. 6 includes equatorial portions (large diameter portions) 600*d*, 600*e*, 600*f*, and 600*g* at a distance R3 from the central axis A. In addition, the cavity main body 600 includes iris portions (small diameter portions) 600*h*, 600*i*, and 600*j* at a distance R4 from the central axis A. As shown in FIG. 6, the distance R4 to the central axis A of the iris portions 600*h*, 600*i*, and 600*j* is shorter than the distance R3 to the central axis A of the equatorial portions 600*d*, 600*e*, 600*f*, and 600*g*. As shown in FIG. 6, the cavity main body 600 has a shape formed, by the equatorial portions 600*d*, 600*e*, 600*f*, and 600*g*, and the iris portions 600*h*, 600*i*, and 600*j* being alternately formed along the direction of the central axis A.

The outer circumferential surface of the cavity main body 600 is coated with a metal material having a higher conductivity than the super conducting material. This coated part forms the metal coating layer 600*a*. As the metal material having a high conductivity, for example, copper, gold, silver, or aluminum is used. The reason for coating the outer circumferential surface of the cavity main body 600 with a metal material having a high conductivity is to make the cavity main body 600 function as an anode during electropolishing.

As shown in FIG. 6, the coating thickness of the metal coating layer 600*a* varies depending on the position in the direction of the central axis A of the cavity main body 600. More specifically, the metal coating layer 600*a* has a coating thickness T2 in the equatorial portions (large diameter portions) 600*d*, 600*e*, 600*f*, and 600*g*. On the other hand, the metal coating layer 600*a* has a coating thickness T1 in the iris portions (small diameter portions) 600*h*, 600*i*, and 600*j*. The coating thickness T2 is larger than the coating thickness T1. The coating thickness of the metal coating layer 600*a* between the iris portions adjacent to the equatorial portion has a shape gradually decreasing in coating thickness from the equatorial portion toward the iris portions.

An outlet part 600*b* and an inlet part 600*c* of the cavity main body 600 are cylindrical openings. As shown in FIG. 6, the diameter of the inner circumferential surface of the outlet part 600*b* and the inlet part 600*c* corresponds to the diameter of the inner circumferential surface of the iris portions 600*h*, 600*i*, and 600*j*, and the each of the diameters is D1. On the other hand, the diameter of the inner circumferential surface of the equatorial portions 600*a*, 600*e*, 600*f*, and 600*g* is D2.

The ratio between the distance R3 to the central axis A of the inner circumferential surface of the equatorial portions and the distance R4 to the central axis A of the inner circumferential surface of the iris portions, and the ratio between the coating thickness T2 of the metal coating layer 600*a* in the equatorial portions and the coating thickness T1 of the metal coating layer 600*a* in the iris portions correspond to each other as expressed by the following equation (1), or substantially correspond to each other.

$$R4/R3-T1/T2 \quad (1)$$

The reason for thus making the coating thickness of the metal coating layer 600*a* thicker in the equatorial portions and making the coating thickness of the metal coating layer 600*a* thinner in the iris portions is to substantially equalize the amount of polishing of the inner circumferential surface of the cavity main body 600 by electropolishing between the iris portions and the equatorial portions. As shown in FIG. 2, the cathode is installed inside the cavity main body during electropolishing. Therefore, if the coating thickness of the metal coating layer 600*a* is constant along the central axis A, the amount of polishing of electropolishing becomes larger in the iris portions which are closer to the cathode, while the amount of polishing of electropolishing becomes smaller in the equatorial portions which are farther away from the cathode. In this embodiment, in order to reduce the difference in the amount of polishing between the iris portions and the equatorial portions, the coating thickness of the metal coating layer 600*a* is made thicker in the equatorial portions, and the coating thickness of the metal coating layer 600*a* is made thinner in the iris portions.

Making the coating thickness of the metal coating layer 600*a* larger in the equatorial portions allows the current to flow more easily to the equatorial portions. On the other hand, making the coating thickness of the metal coating layer 600*a* smaller in the iris portions makes the current flow relatively less easily to the iris portions. For example, by setting the coating thickness of the metal coating layer 600*a* in the equatorial portions and the coating thickness of the metal coating layer 600*a* in the iris portions as expressed by the equation (1), the difference in the amount of polishing between the iris portions and the equatorial portions can be reduced. While the coating thickness of the metal coating layer 600*a* in the equatorial portions and the coating thickness of the metal coating layer 600*a* in the iris portions can be set, for example, as expressed by the equation (1), the coating thicknesses can be appropriately set according to the various conditions so that the amount of polishing is equalized between the iris portions and the equatorial portions.

As has been described above, in the superconducting accelerating cavity of this embodiment, the cavity main body 600 has a shape formed by the equatorial portions (large diameter portions) and the iris portions (small diameter portions), which are at a shorter distance to the central axis A than the equatorial portions, being alternately formed along the direction of the central axis A. In addition, the coating thickness T2 of the metal coating layer 600*a* in the equatorial portions is larger than the coating thickness T1 of the metal coating layer 600*a* in the iris portions.

In this way, current can flow more easily in the equatorial portions which are farther away from the central axis of the cavity main body 600, in which the cathode is disposed during electropolishing, than in the iris portions which are closer to the central axis. Thus, the defect of the degree of polishing of electropolishing becoming non-uniform in the inner surface of the cavity main body 600 can be suppressed.

In the superconducting accelerating cavity of this embodiment, the ratio between the distance R3 to the central axis A of the equatorial portions and the distance R4 to the central axis A of the iris portion, and the ratio between the coating thickness T2 of the metal coating layer 600*a* in the equatorial portions and the coating thickness T1 of the metal coating layer 600*a* in the iris portions correspond to each other or substantially correspond to each other.

In this way, the coating thickness T2 in the equatorial portions and the coating thickness T1 in the iris portions of the cavity main body 600 can be adjusted to a coating thickness according to the distance from the central axis of the cavity main body 600 in which the cathode is disposed during electropolishing.

Other Embodiments

In the first embodiment, the anode part 230 is inserted into the supply port 20*a* and the anode part 240 is inserted into the discharge port 20*b*; however, the present invention may have a different aspect. For example, the anode part may be inserted into only one of the supply port 20*a* and the discharge port 20*b*. Since the metal coating layer 10*a* is evenly formed on the outer circumferential surface of the cavity main body 10, even when the anode part is inserted into only one of the supply port 20*a* and the discharge port 20*b*, the entire outer circumferential surface of the cavity main body 10 can be at the same potential as the positive pole of the power source 250.

The cavity main body 10 of the first embodiment shown in FIG. 1 is formed by four equatorial portions (large diameter portions) and three iris portions (small diameter portions) being alternately formed along the central axis A; however, the present invention may have a different aspect. For example, N equatorial portions and N−1 iris portions may be alternately formed (where N is an integer larger than, one).

The invention claimed is:

1. A superconducting accelerating cavity comprising:

a cavity main body formed of a superconducting material into a cylindrical shape; and a refrigerant tank installed around the cavity main body and storing a refrigerant which is supplied from the outside through a supply port into a space created between the refrigerant tank and the outer circumferential surface of the cavity main body, wherein the outer circumferential surface of the cavity main body is coated with a metal material having a higher conductivity than the superconducting material to make the cavity main body function as an anode during electropolishing, the cavity main body has a shape formed by large diameter portions and small diameter portions, which are at a shorter distance to the central axis of the cavity main body than the large diameter portions, the large diameter portions and the small diameter portions being alternately formed along an axial direction, and the coating thickness of the metal material in the large diameter portions is larger than the coating thickness of the metal material in the small diameter portions.

2. The superconducting accelerating cavity according to claim 1, wherein the cavity main body has a shape formed by large diameter portions and small diameter portions, which are at a shorter distance to the central axis of the cavity main body than the large diameter portions, being alternately formed along the axial direction, and the position of the supply port in the axial direction corresponds to the position of the large diameter portion in the axial direction.

3. The superconducting accelerating cavity according to claim 1, wherein the ratio between the distance to the central axis of the large diameter portions and the distance to the central axis of the small diameter portions, and the ratio between the coating thickness in the large diameter portions and the coating thickness in the small diameter portions substantially correspond to each other.

4. An electropolishing method for a superconducting accelerating cavity comprising: a cavity main body formed of a superconducting material into a cylindrical shape; and a refrigerant tank installed around the cavity main body and storing a refrigerant which is supplied from the outside through a supply port into a space created between the refrigerant tank and the outer circumferential surface of the cavity main body, the outer circumferential surface of the cavity main body being coated with a metal material having a higher conductivity than the superconducting material to make the cavity main body function as an anode during electropolishing, the electropolishing method comprising:

inserting an anode part, which is connected to a positive pole of a power source, through the supply port and bringing the anode part into contact with the outer circumferential surface of the cavity main body;

inserting a cathode part, which is connected to a negative pole of the power source, into the cavity main body;

supplying an electrolyte into the cavity main body; and starting energization by the power source and electropolishing the inner surface of the cavity main body.

5. The electropolishing method for a superconducting accelerating cavity according to claim 4, wherein the cavity main body has a shape formed by large diameter portions and small diameter portions, which are at a shorter distance to the central axis of the cavity main body than the large diameter portions, being alternately formed along an axial direction, and the position of the supply port in the axial direction corresponds to the position of the large diameter portion in the axial direction.

6. The electropolishing method for a superconducting accelerating cavity according to claim 4, wherein the cavity main body has a shape formed by large diameter portions and small diameter portions, which are at a shorter distance to the central axis of the cavity main body than the large diameter portions, being alternately formed along an axial direction, and the coating thickness of the metal material in the large diameter portions is larger than the coating thickness of the metal material in the small diameter portions.

7. The electropolishing method for a superconducting accelerating cavity according to claim 6, wherein the ratio between the distance to the central axis of the large diameter portions and the distance to the central axis of the small diameter portions, and the ratio between the coating thickness in the large diameter portions and the coating thickness in the small diameter portions substantially correspond to each other.

* * * * *